United States Patent [19]

Focke et al.

[11] Patent Number: 5,009,741

[45] Date of Patent: Apr. 23, 1991

[54] METHOD AND DEVICE FOR THE APPLICATION OF REVENUE STAMPS TO PACKS

[75] Inventors: Heinz Focke, Verden; Hans-Jürgen Bretthauer, Bremen, both of Fed. Rep. of Germany

[73] Assignee: Focke & Co. (GmbH & Co.), Verden, Fed. Rep. of Germany

[21] Appl. No.: 420,489

[22] Filed: Oct. 12, 1989

[30] Foreign Application Priority Data

Oct. 15, 1988 [DE] Fed. Rep. of Germany ..... 3835290

[51] Int. Cl.[5] ..... B65C 3/00

[52] U.S. Cl. ..... 156/483; 156/484; 156/486; 156/490; 156/566; 156/567; 156/568; 156/571; 53/234; 53/136.1

[58] Field of Search ..... 53/137, 234; 156/483, 156/484, 485, 486, 489, 490, 491, 566, 567, 568, 571

[56] References Cited

U.S. PATENT DOCUMENTS 4,655,871 4/1987 Mattei et al. ..... 156/568 X
4,762,587 8/1988 Deal ..... 156/567 X
4,840,007 6/1989 Focke et al. ..... 53/137

*Primary Examiner*—David A. Simmons
*Assistant Examiner*—James J. Engel, Jr.
*Attorney, Agent, or Firm*—Sughrue, Mion, Zinn, Macpeak & Seas

[57] ABSTRACT

A device for the application of labels to packages, such as cigarette packs. Each label is applied to one or more faces or end portions of the pack. The application of the comparatively small labels to the packs can impair the performance of a packaging machine. According, the present mechanism continuously transfers the labels to packs, during the continuous transportation of each pack between two processing station by a label conveyor. The conveyor includes several label holders, each of which has a pocket to retain a package within. As the conveyor rotates between stations, the package is shifted within the pocket, and is forced through a label holder. The label holder, retains a label in a position perpendicular to the direction in which the package is moved. Thus as the package is forced through the label holder the label adheres to the package. In this manner, label application is achieved in a continuous process.

7 Claims, 6 Drawing Sheets

METHOD AND DEVICE FOR THE APPLICATION OF REVENUE STAMPS TO PACKS

Figure 1:
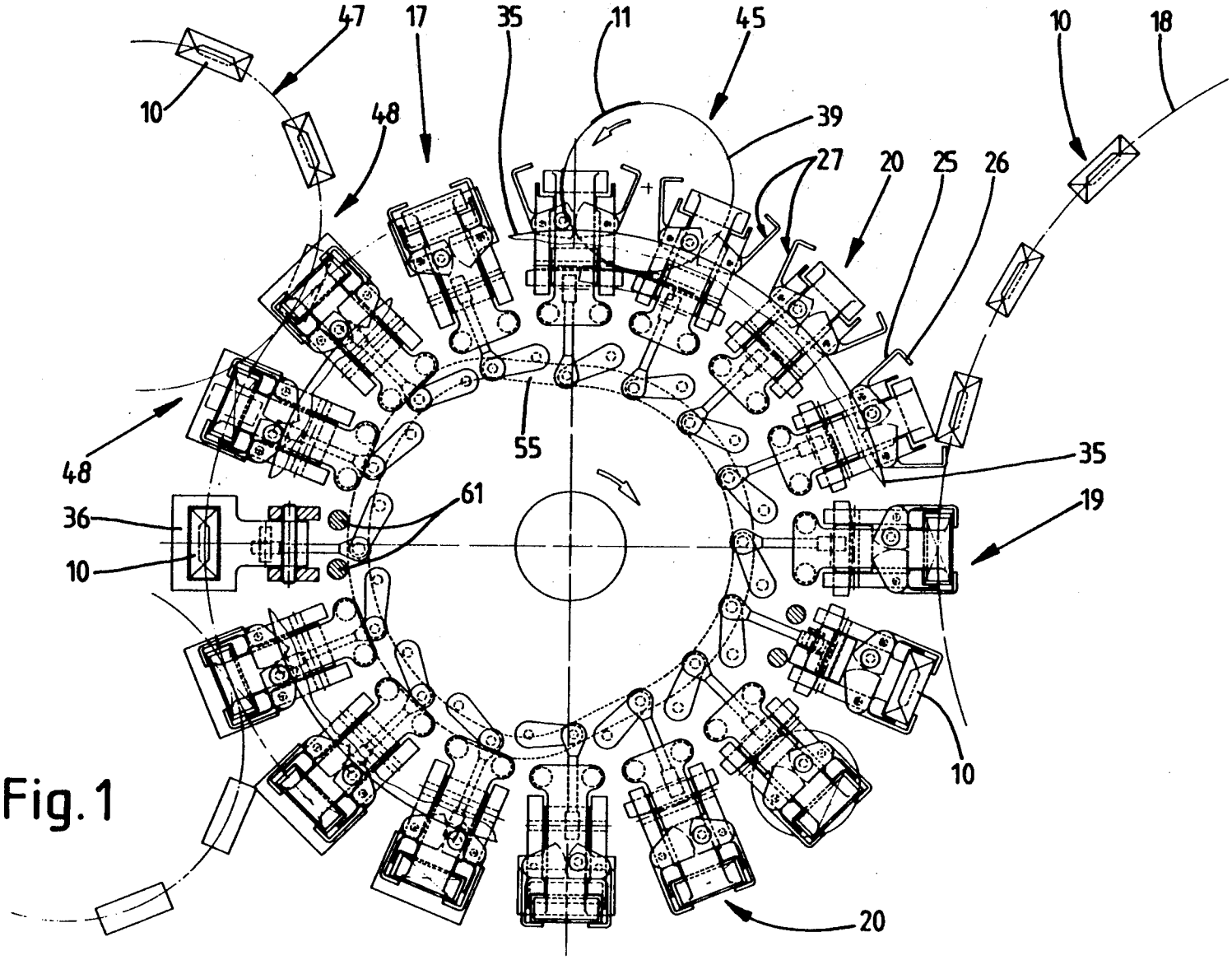

The invention is concerned with a method of application of revenue stamps (for duty or sealing) to (end-)faces of parallelpipedal packs, in particular for cigarettes, where the revenue stamps also extend into the region of at least one further face of the pack, adjoining the endface. Moreover the invention refers to a mechanism for the performance of the aforesaid method.

Packs of cigarettes and other dutiable products are provided in many countries with a revenue stamp showing the duty. This is arranged in the region of the endface of the pack and extends as far as into one of the adjoining faces of the peak. Often, in particular in the case of packs in jars, the revenue stamp is folded in a U-shape transversely across the endface, in which case arms are arranged in the region of the front and back of the pack. But revenue stamps may furthermore also be present for other reasons and of other materials in the case of packs of that kind, e.g., as means of sealing.

In the case of high-performance packaging machines the application of revenue stamps causes problems. This applies above all in the case of continuously operating packaging machines if units for the application of the revenue stamps, as has been usual hitherto, operate in cycles.

The problem underlying the invention is to increase the performance of packaging machines in the region of the application of revenue stamps, and in particular to design the process of application to be continuous.

For the solution of this problem the method in accordance with the invention is characterized by the following features:

(a) the packs are conveyed continuously with their longitudinal axes pointing transversely to the direction of conveyance;

(b) during conveyance the packs are shifted transversely to the direction of conveyance for taking over a revenue stamp, with the endface pointing in the direction of shift;

(c) for each pack one revenue stamp is held ready in the region of the transverse shift, in a plane parallel with the endface;

(d) during the transverse shift the pack is moved through the plane of the revenue stamp, taking it along by the endface.

In the case of the invention the union of the pack and the revenue stamp is effected during the preferably continuous transport of the pack. Also the revenue stamp is conveyed in accordance with the invention at least temporarily in step or in synchronism with and in parallel with the pack.

Preferably upon takeover of the revenue stamp by the pack, arms of the revenue stamp standing out beyond the endface become folded round against the front and back of the pack.

According to a further important feature of the invention the revenue stamps are first of all positioned and conveyed in a plane transverse to the endface of the pack and also raised during transport into a plane parallel with the endfaces. A machine-adapted feed of revenue stamps and packs is thereby possible to a common endless conveyor.

The mechanism in accordance with the invention for the application of revenue stamps to packs is characterized in that the packs [may be conveyed] by a continuously driven endless conveyor in a direction transverse to the longitudinal axis of the pack and in the region of the endless conveyor with their endfaces pointing in the direction of shift may be pushed by transversely directed sliders through the plane of an accompanying revenue stamp positioned in parallel with the endface, so carrying the same along by the endface.

The endless conveyor is logically a continuously rotating (revenue-stamp) turntable which picks up both the packs and revenue stamps along its periphery and transports them together. During conveyance the union of the packs with the revenue stamps is effected by shifting of the packs in parallel with the axis through the plane of the revenue stamps transverse to the axis, so carrying them along.

According to a further proposal of the invention the revenue stamps are brought up to the revenue-stamp turntable and conveyed tangentially to it or oriented in a direction circumferential to it. During transport a raising of the revenue stamps is effected into a plane parallel with the endface of the packs.

The revenue-stamp turntable in accordance with the invention is provided with members for folding the arms of the revenue stamp against the front and back of the pack, in particular with a mouthpiece in front of which the revenue stamp is held ready and through which the pack may be pushed, carrying along and folding the revenue stamp. The mouthpiece is at the same time the holding member for the revenue stamps on the revenue-stamp turntable.

Further features of the invention are concerned with the design of the revenue-stamp turntable and its members as well as the conveyance of the packs and revenue stamps up to it and away.

Figure 2:
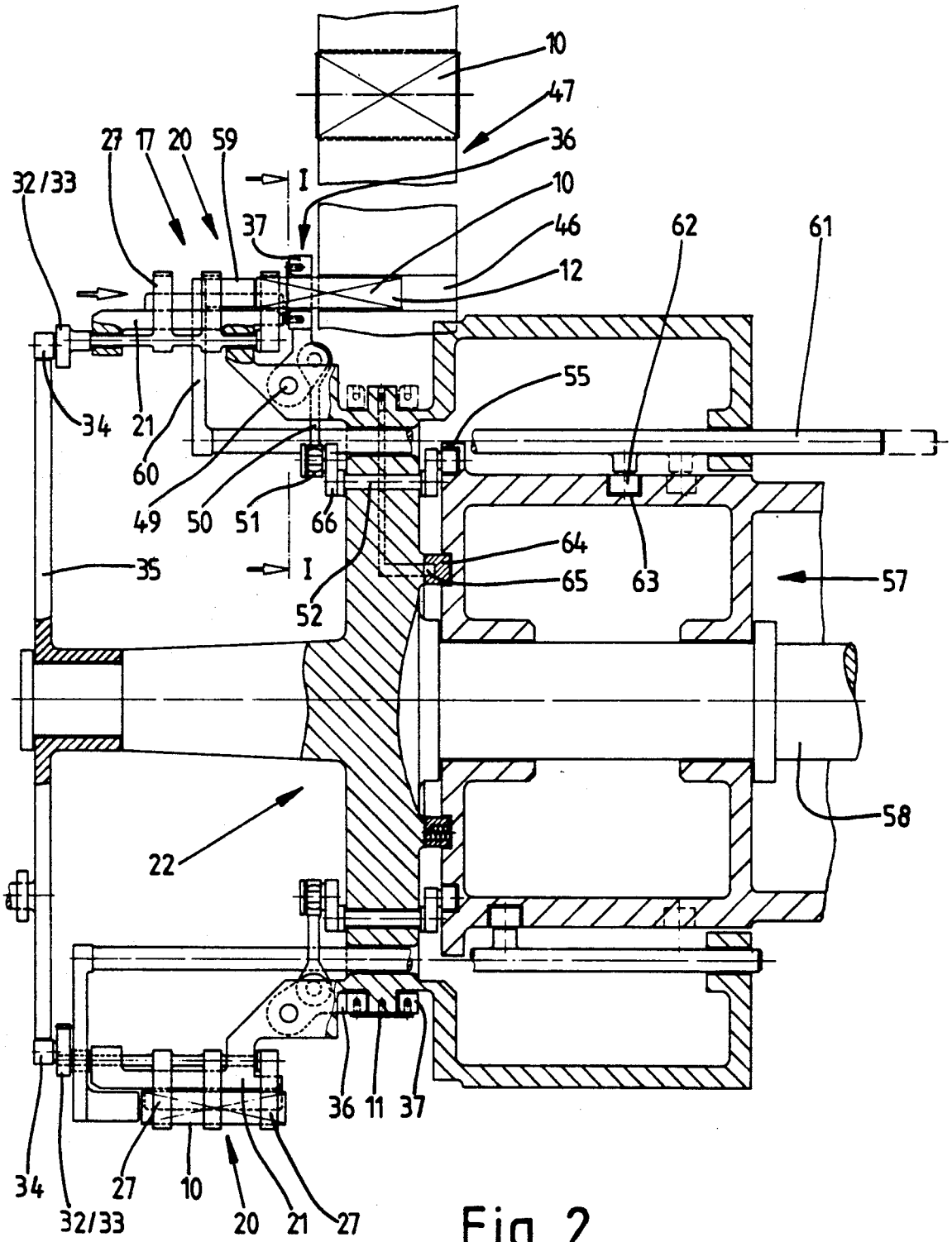
Figure 3:
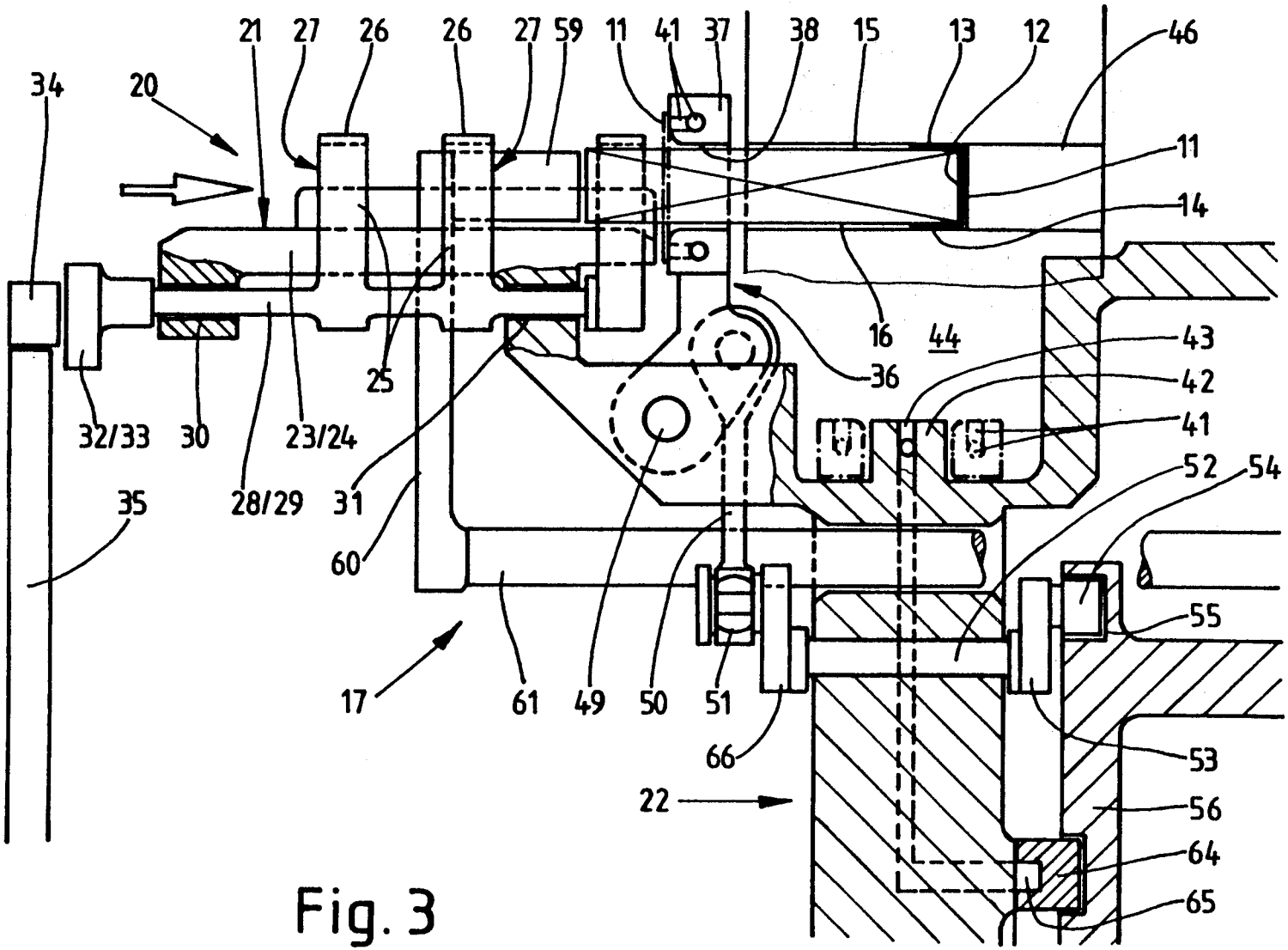
Figure 4:
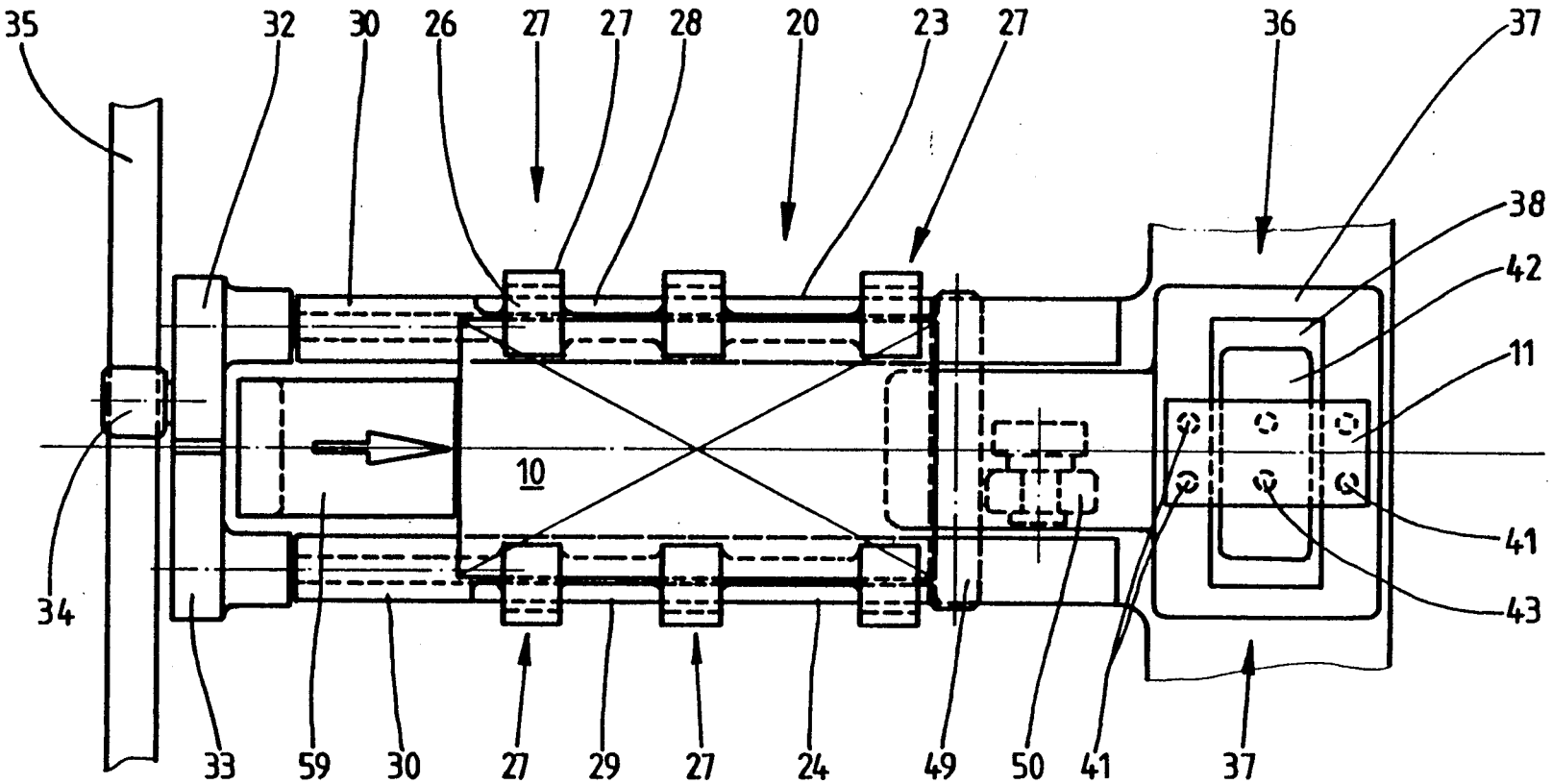
Figure 5:
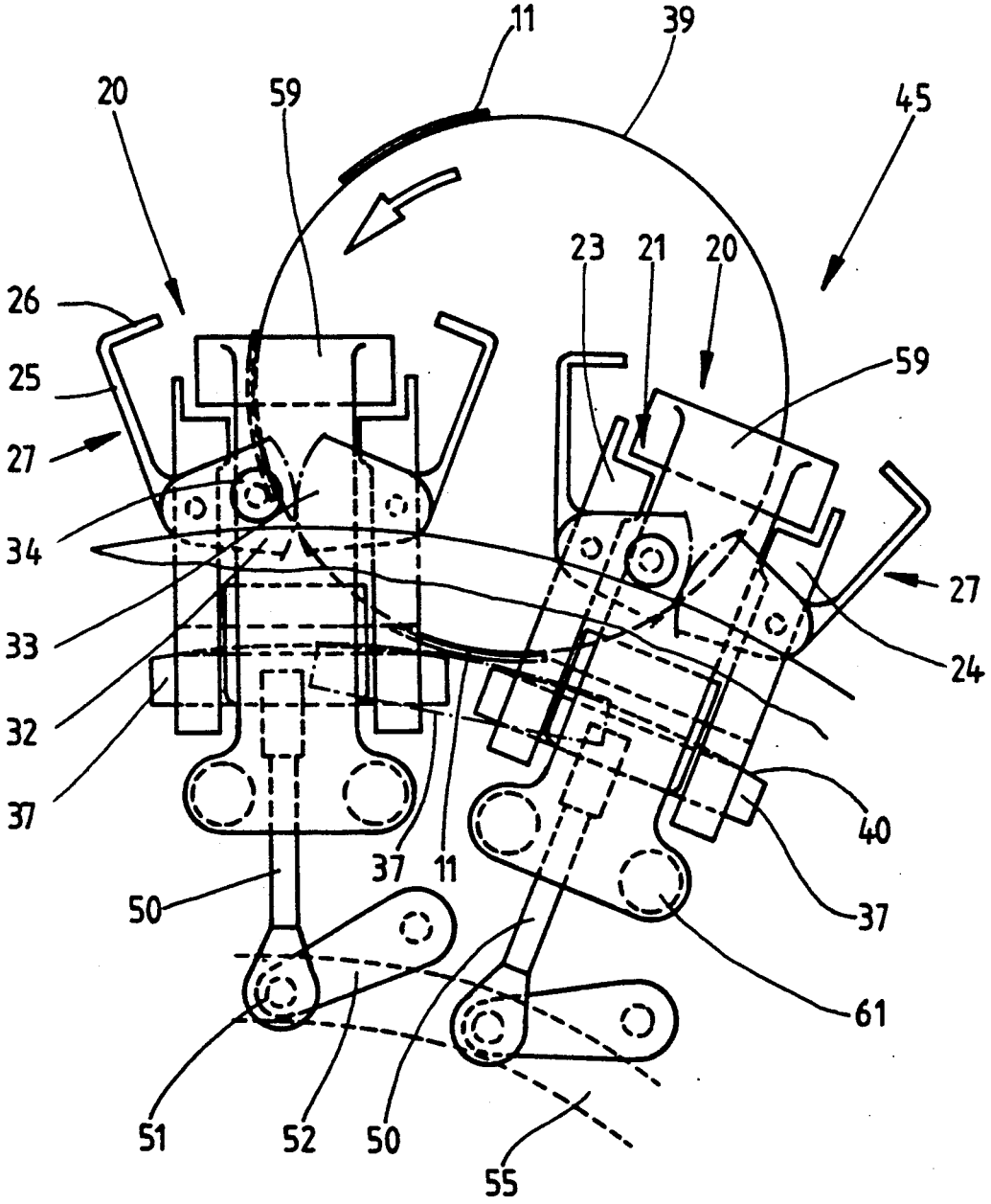
Figure 6:
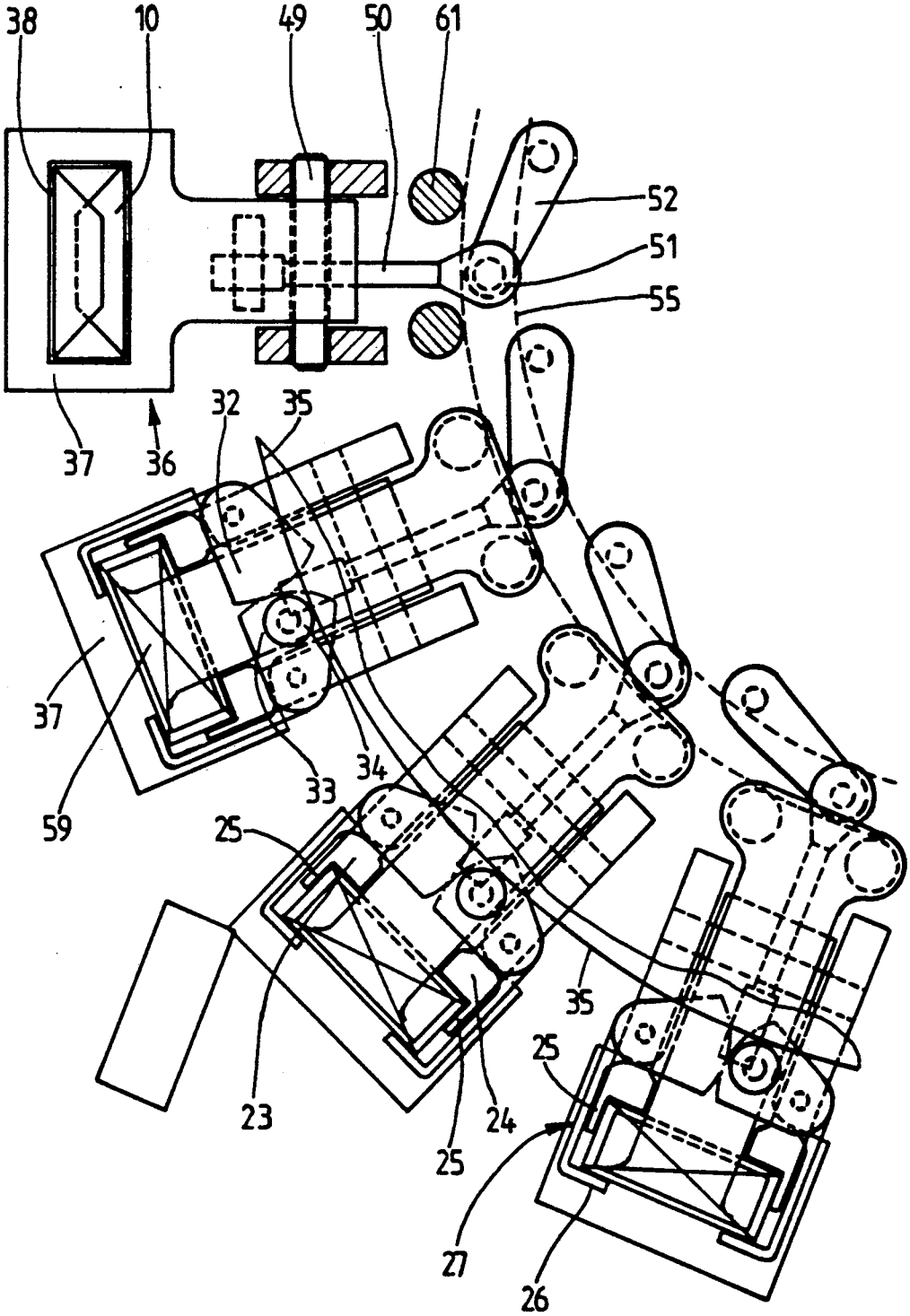

An embodiment of the mechanism in accordance with the invention is explained in greater detail below with the aid of the drawings. There is shown in:

FIG. 1—a revenue-stamp turntable in side elevation;

FIG. 2—a radial section through the revenue-stamp turntable in accordance with FIG. 1, on a larger scale;

FIG. 3—a detail of the revenue-stamp turntable in radial section, again on a larger scale;

FIG. 4—a mounting for packs (pocket) as well as for revenue stamps (mouthpiece) in plan of the folder-turntable as a detail, again enlarged;

FIG. 5—a detail of the folder-turntable, that is, pockets of it in a view directed axially;

FIG. 6—a detail corresponding with FIG. 5 with the relative positions of the members altered.

The mechanism represented in the drawings is part of a packaging machine for parallelpipedal (cigarette) packs 10. A (duty) revenue stamp 11 is to be applied to these, which in the present case has the shape of a rectangular strip. This has to extend in a U-shape transversely across one endface 12 of the pack 10 with arms 13, 14 in the region of the front 15 and back 16 of the pack 10.

The core of the mechanism is an endless conveyor in the form of a revenue stamp turntable 17. The finished packs 10 are conveyed to it by a turntable or folder-turntable 18 arranged before it. The packs 10 are transferred in a transfer station 19 to the revenue-stamp turntable 17, that is, by the path of motion of the packs 10 entering the path of revolution of pockets 20 on the revenue-stamp turntable 17. In the range of momentary synchronism the packs 10 are taken over one at a time by a pocket 20 on the continuously revolving revenue-stamp turntable 17.

The packs 10 are oriented at the periphery of the revenue-stamp turntable 17 with their longitudinal extent in parallel with the axis. The endfaces 12 consequently extend in a plane transverse to the axis. The front 15 and back 16 of the pack 10 lie radially inwards and outwards with respect to the revenue-stamp turntable 17.

The pockets 20 exhibit a pocket bottom 21 lying radially inwards. This is formed by carrier-pieces 23, 24 at the sides, connected rigidly to a turntable body 22. They are provided at the sides with upright side-flanges 25 for defining the sides of the pocket 20.

At the sides of the pockets 20 which are on the outside in the radial direction the packs 10 are confined by outer arms 26 which embrace and hold the pack 10 at the side which is on the outside in the radial direction. For the introduction of a pack 10 into a pocket 20 the outer arms 26 are moved out of the holding position so that the pocket 20 is completely open at the outside.

The outer arms 26 are for this purpose part of angular holders 27 of which a number—in the present case three—are arranged spaced apart along the length of the pocket 20. The holders 27 are connected in each case to a common spindle 28 or 29 at the two sides of the pocket 20. By turning the two spindles 28, 29 in opposite directions the holders 27 arranged at the two sides of the pocket 20 are moved into or out of the holding position with respect to the pocket 20. The spindles 28, 29 are supported in pivots 30, 31 in the carrier-pieces 23, 24.

A drive for the turning motion of the spindles 28, 29 lies next the pockets 20 at the side. For this purpose toothed segments 32, 33 which mesh with one another are arranged at their ends. One of these toothed parts 32 in each case is provided with a follower roller 34 which runs along a cam disc 35. The opening and closing positions of the pockets 20 during the turning of the revenue-stamp turntable 17 is determined by the shape of the stationary cam disc 35.

The revenue stamps 11 are first of all brought up against the endface 12 of the pack 10 in the region of the revenue-stamp turntable 11 and folded in the shape of a U in further course.

The revenue-stamp turntable 17 is for this purpose provided with handling members for the revenue stamps 11, which take up one revenue stamp 11 at a time and move it into the position necessary for takeover by a pack 10.

A revenue stamp holder 36 is associated with each pocket 20 for doing this. The revenue stamp holder 36 is in each case arranged at the free side of the pocket 20 lying opposite the cam disc 35.

The most important part of the revenue stamp holder 36 is a mouthpiece 37 which here is made as a rectangular frame. It surrounds a push-through opening 38 the dimensions of which are matched to the shape and size of the cross-section of the pack 10. One revenue stamp holder 36 is associated with each pocket 20 of the revenue-stamp turntable 17.

The revenue stamp holders 36 are arranged on the revenue-stamp turntable 17 to be movable, that is, to be able to pivot. During the revolution of the revenue-stamp turntable 17 they are moved out of a reception position—in a plane parallel with the axis of the turntable—into a transfer position—a plane transverse to the axis—and back again.

In the reception position (the dash-dot position of the mouthpiece 37 in FIG. 3) the revenue stamp holder 36 is lying in a position in which a revenue stamp feeder 39 can lay down one revenue stamp 11 at a time on the mouthpiece 37 directed in parallel with the axis. The revenue stamp feeder 39 is here made as a drum on the circumference of which the revenue stamps 11 are arranged and held by suction air. In that case the circumference of the revenue stamp feeder 39 is laid against the upper side (holder side) of the mouthpiece 37. As may be seen from FIG. 5, the latter is made with an arch 40 so that the drum-shaped revenue stamp feeder 39 can roll against the mouthpiece 37.

The mouthpiece 37 is provided with drilled suction holes 41 opening out in the region of the holding side, which hold the revenue stamp 11 during transport until the transfer to the pack 10. For the takeover of the revenue stamp 11 from the revenue stamp feeder 39 a stationary base 42 is arranged in the push-through opening 38 in the mouthpiece 37 and connected to the turntable body 22, and likewise exhibits a drilled suction hole 43. Consequently in this region the area of contact for the revenue stamp 11 and also the holding force are increased. For the takeover of a revenue stamp 11 the mouthpiece 37 lies in the region of a depression 44 in the revenue-stamp turntable 17, which is open radially to the outside. The feed of the revenue stamps 11 from outside is thereby possible.

During the turning of the revenue-stamp turntable 17 from a feed station 45 arranged here in the upper region, a gradual pivoting motion of the revenue stamp holder 36 is effected from the reception position in parallel with the axis into the transfer position transverse to the axis (solid lines in FIG. 3). The takeover of the revenue stamp 11 by a pack 10 is effected during the turning of the revenue-stamp turntable 17 through a shifting of a pack 10, directed in parallel with the axis, into the pocket 20 and out of it again. The shifting of the pack 10 is effected in the direction towards the mouthpiece 37 and through it. In doing so the revenue stamp 11 held ready transversely to the endface 12 of the pack 10, is laid round the endface 12 as well as against the adjoining sides of the pack 10. The pack 10 provided with the revenue stamp 11 enters a chamber 46 in a pack conveyor 47. The transfer of the packs 10 with revenue stamps 11 to the pack conveyor 47 is effected in the region of a transfer station 48 during momentary alignment of the pocket 20 with the chamber 46. Thereupon the revenue stamp holder 36 is swung back into its reception position and the pocket 20 is opened by swivelling of the holders 27.

For swivelling the revenue stamp holder 36 it is supported movably on the turntable body 22 by a pivot bearing 49. The movement is effected by a rocking lever 50 which is connected via a ball-and-socket joint 51 to a crank 52 which is driven to swing to and fro. The latter is driven via a crankshaft 66 with a driving crank 53 from a guide roller 54 which runs in a cam groove 55. The latter is formed in a stationary cam disc 56 in a cam pot 57. The latter is connected to be unable to twist to a machine housing (not shown) and bears against a rotating turntable shaft 58.

For shifting the packs 10 in parallel with the axis into the pockets 20 or respectively out of them a slider 59 is associated with each pocket 20. Each slider 59 is fitted to an arm 60 which is movable to and fro between the carrier-pieces 23, 24 of the pocket bottom 21. The arm 60 is in turn connected to (two) slider rods 61 which are guided in parallel with the axis. Follower rollers 62 fitted to the side of the slider rods 61 enter a cam groove 63 at the circumference of the cam pot 57. The shifting of the slider rods 61 and thereby the slider 59 in parallel with the axis is effected by the design of the cam groove 63. The slider 59 is so constructed that in pushing the pack 10 out of the pocket 20 it goes through the push-through opening 38 in the mouthpiece 37 for complete transfer of the pack 10 to the pack conveyor 47.

The cam pot 57 is arranged stationary, hence the turntable body 22 is driven to turn relatively to it. The cam disc 35 for actuation of the holders 27 associated with the pockets 20 is supported stationary on a projecting end of the turntable shaft 58, that is, able to turn relatively to it. The stationary cam pot 57 also serves for feeding suction air to the base 42 in the usual way via a pressure ring 64 with an annular groove 65, connected to the cam pot 57.

We claim:

1. A mechanism for individually applying labels, such as revenue stamps, to faces of rectangularly shaped packs, said labels extending onto adjoining faces of the packs, comprising:

an endless label conveyor, provided with multiple pack transport sections, for continuously conveying said packs between processing stations of said mechanism, wherein said label conveyor has at least one axis around which the conveyor rotates, said axis being oriented perpendicular to a direction of rotation of said conveyor, each of said transport stations comprising:

a slide for moving each corresponding pack in a direction parallel to said axis, from a pack reception point to a pack transfer point, and a label holder, with a mouth piece, said label holder arranged to hold the label against said mouth piece, and in a plane transverse to said axis, said slide moving said pack through the mouth piece, and through the plane of said label, thereby causing said label to contact and stick to said pack, wherein each label is adhered to each pack as said label conveyor rotates between processing stations.

2. A mechanism as in claim 1, wherein each of said transport stations further includes a pocket to hold each pack place therein, said slide shifting said pack within said pocket in a direction parallel with the axis, thereby moving said pack through a push-through opening in said mouthpiece (37), wherein a label spans said push-through opening (38), and contacts said pack (10) when said pack passes through said opening.

3. A mechanism as in claim 1, wherein said mouthpiece is arranged in a reception position, parallel with said axis, for allowing placement of each label onto the label holder, said mouthpiece thereafter, is pivoted to a position arranged transversely to said axis.

4. A mechanism as in claim 3, characterized in that when the mouthpiece is in the raised position transverse to the axis, the label is arranged on the side of said mouthpiece nearest the pack, such that upon pushing the pack (10) though the mouthpiece (37) the label will lie in a U-shape over one side portion and adjoining faces of the pack.

5. A mechanism as in claim 4, wherein each of said transport stations further comprise a stationary base, arranged to lie within a push-through opening of and substantially flush with said mouthpiece when said mouthpiece is in said reception position, thereby providing additional holding support of said label, while placing said label on the mouthpiece, said mouthpiece and said stationary base using suction to hold the label thereon.

6. A mechanism as in claim 2, wherein said pocket is formed at each transport station by holders used to confine and direct the motion of each pack through said push-through opening of the mouthpiece, said holders being outwardly pivotal from said pocket such that said pocket is able to receive each pack when said holders are outwardly pivoted.

7. A mechanism as in claim 6, characterized in that the pivoting movement of each mouthpiece as well as the sliding movement of each slider (59) are controlled by cam grooves (56, 63) in a common stationary cam pot (57) via guide rollers (54) or follower rollers (62).

* * * * *